US006571841B1

(12) United States Patent
Patton

(10) Patent No.: US 6,571,841 B1
(45) Date of Patent: Jun. 3, 2003

(54) UNIT AND METHOD FOR BENDING WOOD

(76) Inventor: Arliss Patton, 6401 Fairview Dr., King George, VA (US) 22485

( * ) Notice: Subject to any disclaimer, the term of this patent is extended or adjusted under 35 U.S.C. 154(b) by 0 days.

(21) Appl. No.: 10/121,671

(22) Filed: Apr. 15, 2002

(51) Int. Cl.[7] ..... B27H 1/00

(52) U.S. Cl. ..... 144/381; 29/464; 29/897.312; 33/27.03; 33/320; 100/35; 100/917; 156/443; 144/256.1; 144/269; 144/349; 269/8; 269/276; 269/910

(58) Field of Search ..... 29/464, 897.31, 29/897.312; 156/60, 443, 349; 33/27.01, 27.03, 27.032, 27.04, 320, 613, 669; 269/8, 45, 276, 910; 144/256.1, 256.3, 269, 270, 349, 381; 100/35, 917

(56) References Cited

U.S. PATENT DOCUMENTS 3,307,988 A 3/1967 Berg
3,824,919 A * 7/1974 Moehlenpah ..... 100/35
4,032,130 A 6/1977 Huntley et al.
4,679,781 A 7/1987 LePoire
4,711,281 A 12/1987 Kessel et al.
4,886,568 A 12/1989 Strozier
4,967,816 A 11/1990 Postema
5,203,948 A * 4/1993 Suska ..... 156/443
5,293,961 A 3/1994 Postema
5,361,495 A * 11/1994 Pyle et al. ..... 29/897.31

OTHER PUBLICATIONS

Protech Machinery, Inc.

* cited by examiner

*Primary Examiner*—W. Donald Bray
(74) *Attorney, Agent, or Firm*—Terry M. Gernstein

(57) ABSTRACT

Wood is bent using a unit and a method in which a continuous and uninterrupted curved path is defined over a workpiece-supporting surface and form and clamp blocks are electromagnetically attached to the workpiece-supporting surface adjacent to the path. The form and clamp blocks engage a wood workpiece to force that workpiece into a shape that matches the path defined over the workpiece-supporting surface.

24 Claims, 11 Drawing Sheets

UNIT AND METHOD FOR BENDING WOOD

TECHNICAL FIELD OF THE INVENTION

The present invention relates to the general art of woodworking, and to the particular field of woodworking with bending, and specifically to woodworking with bending concurrent with or subsequent to bonding.

BACKGROUND OF THE INVENTION

The building industry has long used wood that has been shaped into arcuate shapes. Such arcuate shapes have been used in doorways, windows and the like as well as many other applications that will occur to those skilled in the art. Some of the shapes require simple curves, while others may require complex and/or compound curves. These curved shapes have been achieved using wood that has been specially grown, or combining short wood shapes, or by bending wood into the desired shape. Bending wood provides the most versatility and thus is the most desirable for modern needs.

Some applications require strong wood, as for supports or the like. However, strong wood may be difficult to bend because the very characteristic desired, strength, makes it difficult to bend or shape the wood. The art thus contains examples of machines that can be used to bend wood, even strong or thick wood. Such machines include hydraulics or mechanical elements. While somewhat successful in some applications, these machines can be very complex, expensive and difficult to operate. Often, such machines require special skills of an operator thereby limiting the versatility of such machines.

Therefore, there is a need for a unit and a method for bending wood that can be used in a wide variety of applications, even for strong and/or thick wood.

If a worker must learn special techniques to operate a machine, there will be a loss of time during the learning process. There may even be a loss of product as mistakes are made during the learning process.

There is a still further need for a unit and a method for bending wood that is easy to use and easy to learn, even by a non-skilled worker.

Laminated elements are often used in many applications. As is known, laminated elements are formed by adhesively fixing a plurality of individual elements, or layers, together. However, during the drying process for the adhesive, the individual layers can slip relative to each other. Such a situation is very undesirable as the finished product may be unusable. Many machines and processes for bending wood have a disadvantage if laminated products are to be bent because the layers may slip relative to each other during the bending process. This may be especially true if the laminated product is difficult to bend and requires great pressure to achieve the desired bending. Great bending pressure may increase the possibility of layer relative slippage in a laminated product.

Therefore, there is a need for a machine and process for bending laminated products that has a low probability of causing individual layers of the product to slip with respect to each other during the bending process.

While the art has many machines that can bend wood, some of these machines are so complicated to set up and operate that only highly skilled and specialized workers can properly operate them. For example, some of the presently-available machines require computer programs to set a curve to be achieved by wood being bent. Thus, only workers who are adept at computer programs can fully obtain the benefits of such machines.

Therefore, there is a need for a machine and process for bending wood that can be fully utilized by a worker that is not highly skilled.

While the above-discussed drawbacks inhibit the full realization of the advantages associated with woodbending, by far the most serious disadvantage of presently-available machines and processes is the limited nature of the control that can be exercised over the curve being set for the wood. That is, some parts of the desired curve cannot be fully controlled using presently-available machines and processes. There are discontinuities in the control curve of presently-available machines and processes. This can best be visualized by analogy. It can be visualized by comparing a digital control to an analog control. Since a digital control is finite, no matter how fine the increments are, there will be discontinuities between set intervals. Such discontinuities are inherent in a digital control and cannot be avoided. Thus, there will be some areas of a digitally set control curve that simply cannot be controlled due to the inherent discontinuous nature of digital control. On the other hand, however, an analog control is, by its nature, continuous. Since an analog controlled curve is continuous and uninterrupted, there will be no areas of such an analog controlled curve that cannot be controlled.

Therefore, there is a need for a machine and a process for bending wood that can set a continuous and uninterrupted control curve for the bent wood.

Still further, many woodworking processes generate a great deal of debris, such as dust, adhesive and the like. Such debris may clog or damage presently-available machines, especially those that have a great many complicated and complex parts, such as screws, computers and the like. Such machines may have to be cleaned on a very short interval. This may be costly in time as well as manpower.

Therefore, there is a need for a machine and a process for bending wood that is not susceptible to clogging and the like due to debris associated with a woodworking process.

Still further, many presently-available machines are difficult to clean. Thus, if adhesive or dust settles in the parts of some presently-available machines, the machine may be subject to a long downtime and may require a great deal of service to clean. This can be expensive in both time and costs and thus can be undesirable.

Therefore, there is a need for a machine and a process for bending wood that is easily and quickly cleaned.

Most presently-available machines are quite bulky and large. Therefore, when the machine is not in use, a great deal of space can be occupied that might otherwise be used for other purposes. This can translate into a cost.

Therefore, there is a need for a machine and a process for bending wood that is easily, quickly and conveniently stored when not in use.

Many presently-available machines are designed for a particular application. Such machines may not be easily adapted for other applications and thus are not as versatile as they could be. Such lack of versatility can be viewed as an increase in cost for the machine.

Therefore, there is a need for a machine and a process for bending wood that is easily and quickly modified for a wide variety of jobs.

Many presently-available machines and processes require complex procedures for set up. This is especially true for the machines that use computers. Such machines cannot be quickly set up especially by an unskilled worker. Long set up times can be costly.

Therefore, there is a need for a machine and a process for bending wood that is easily and quickly set up, even by an unskilled worker.

OBJECTS OF THE INVENTION

It is a main object of the present invention to provide a unit and a method for bending wood that can be used in a wide variety of applications, even for strong and/or thick wood.

It is another object of the present invention to provide a unit and a method for bending wood that is easy to use, even by a non-skilled worker.

It is another object of the present invention to provide a machine and process for bending laminated products that has a low probability of causing individual layers of the product to slip with respect to each other during the bending process.

It is another object of the present invention to provide a machine and process for bending wood that can be fully utilized by a worker that is not highly skilled.

It is another object of the present invention to provide a machine and a process for bending wood that can set a continuous and uninterrupted control curve for the bent wood.

It is another object of the present invention to provide a machine and a process for bending wood that is not susceptible to clogging and the like due to debris associated with a woodworking process.

It is another object of the present invention to provide a machine and a process for bending wood that is easily and quickly cleaned.

It is another object of the present invention to provide a machine and a process for bending wood that is easily and quickly learned.

It is another object of the present invention to provide a machine and a process for bending wood that is easily, quickly and conveniently stored when not in use.

It is another object of the present invention to provide a machine and a process for bending wood that is easily and quickly modified for a wide variety of jobs.

SUMMARY OF THE INVENTION

These, and other, objects are achieved by a unit for bending wood or other material into arcuate shapes which comprises a magnetically attractive workpiece-supporting surface, a trammel that is magnetically fixed to the workpiece-supporting surface at a center of curvature of a desired arcuate shape for a wood workpiece-when in use, a curve identifying element on the trammel that is set to define a radius of curvature for the desired arcuate shape when the trammel is moved over the workpiece-supporting surface, a continuous and uninterrupted curve defined by the curve identifying element as the trammel is moved over the workpiece-supporting surface, a form block that is fixed to the workpiece-supporting surface adjacent to the curve at a selected position, an electromagnet in the form block fixing the form block to the workpiece-supporting surface, a clamp block that is fixed to the workpiece-supporting surface adjacent to the curve and adjacent to the form block, and an electromagnet in the clamp block fixing the clamp block to the workpiece-supporting surface. A method for achieving these, and other, objects includes providing a magnetically attractive workpiece-supporting surface, defining a continuous and uninterrupted first arcuate portion for a wood workpiece, locating a plurality of form blocks at any and all desired locations adjacent to the continuous and uninterrupted first arcuate portion for the wood workpiece, locating a clamp block adjacent to each form block of the plurality of form blocks, electromagnetically fixing all of the form blocks and all of the clamp blocks to the workpiece-supporting surface, placing a wood workpiece between at least one form block and adjacent to a clamp block, securely clamping the wood workpiece between the one form block and the adjacent clamp block, repeating the steps of securely clamping the wood workpiece between form blocks and clamp blocks until the wood workpiece has been securely clamped between all form blocks and the clamp blocks adjacent thereto.

Using the machine and method of the present invention permits wood, even laminated wood, to be bent in a very accurate manner, while still being easily and quickly set up and carried out even by a relatively unskilled worker. The continuous and uninterrupted nature of the control curve permits the form blocks and the clamp blocks to be set at any and all desired locations whereby the most effective application of bending forces can be applied to the wood. The holding and clamp blocks apply even pressure to the wood over the entire width of the wood, no matter how wide or narrow the wood, whereby no slippage between laminated layers will occur during the bending and drying process. Due to the continuous and uninterrupted nature of the control curve, the form and clamp blocks can be easily and quickly set up even by a non-skilled worker so the machine and process of the present invention are extremely versatile. The electromagnetic features of the machine and process permit quick set up of the machine and its parts, yet will hold the form and clamp blocks securely enough even for thick wood. The form and clamp blocks can be easily moved into the desired locations and then the electromagnets activated to securely fix those elements in place. Since the electromagnets are not activated until after the blocks are in the desired locations, movement and adjustment of the blocks is quick and easy. Since the blocks are held electromagnetically, the blocks are held in place securely enough for all purposes and applications.

The machine and process are extremely versatile so the workpiece-supporting surface can be used for other jobs as well as simply bending wood. Still further versatility is added because the machine and process of the present invention is amenable to use with conventional techniques and knowledge so a worker is not required to learn new techniques which will substantially increase the efficiency of the machine and process. Many different types of curves, even complex and compound curves, are easily formed using the machine and process of the present invention. The workpiece-supporting surface can be easily fit into any available space

BRIEF DESCRIPTION OF THE DRAWING FIGURES

DETAILED DESCRIPTION OF THE PREFERRED EMBODIMENT OF THE INVENTION

Other objects, features and advantages of the invention will become apparent from a consideration of the following detailed description and the accompanying drawings.

The machine and method embodying the teaching of the present invention quickly and easily defines a continuous and uninterrupted control curve and then permits quick and easy set up of wood contacting elements along that control curve whereby any desired degree of accuracy can be easily achieved even by a non-skilled worker. Compound and complex wood curves can be easily achieved, and the equipment is not subject to damage by debris and can be easily cleaned if debris is present. The wood contacting elements are held in place by electromagnets so they are easily and quickly moved into desired positions, and then can be quickly activated to be securely held in place even if the wood being bent is thick and difficult to bend.

Referring to the figures, the machine or unit embodying the present invention will be described first and then the method of bending wood embodying the teaching of the present invention will be described.

Figure 14:
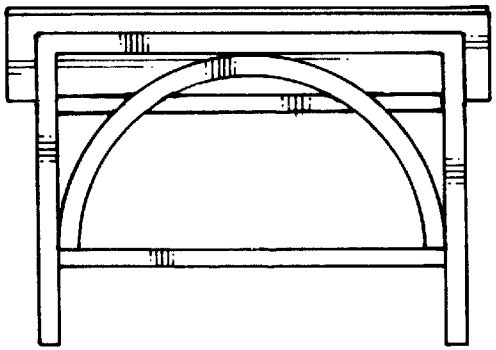
FIG. 14 is a rear view of the workpiece-supporting table.
Figure 15:
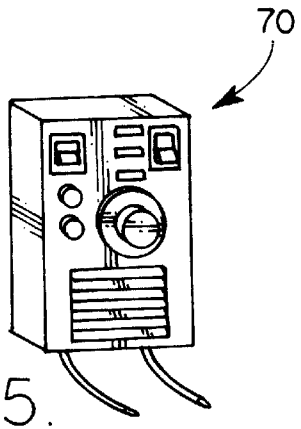
FIG. 15 shows a control unit for controlling operation of the electromagnets of the unit of the present invention.
Figure 12:
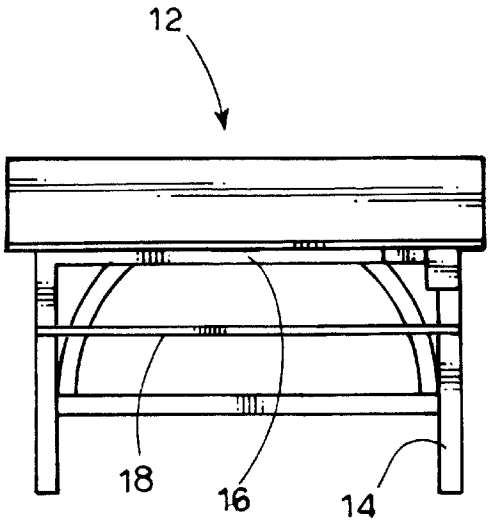
FIG. 12 is a front elevational view of a workpiece-supporting table used in the unit of the present invention.
Figure 13:
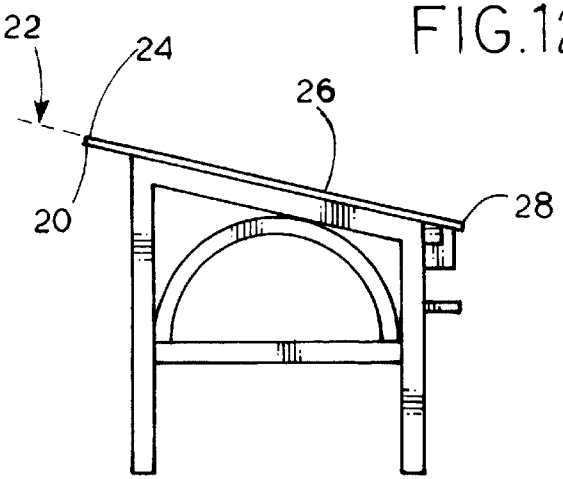
FIG. 13 is a side elevational view of a workpiece-supporting table used in the unit of the present invention, the other side being a mirror image of the side shown in FIG. 13.

A unit or machine 10 of the present invention for bending wood into arcuate shapes comprises a planar magnetically attractive workpiece-supporting surface 12 that is best shown in FIGS. 12–14 and, in one form, is supported on legs 14 a support surface 16 and brace elements 18. Surface 12 can be oriented to be parallel to a floor, or at an oblique angle to that floor if desired. Furthermore, surface 12 can be one-piece or can be a unit formed of several interlocking pieces which can be folded at joints for storage. Still further, add-on pieces of surface 12 can be included to increase the size and work area of surface 12 if desired. This is indicated in FIG. 13 where a hinge 20 attaches an add-on section 22 to support surface 12. As will be understood by those skilled in the art based on the teaching of this disclosure, add-on section 22 can be located on top edge 24 or either side edge 26 or bottom edge 28 of surface 12 and further hinges can be included to make a stored configuration for surface 12 even smaller. One form of surface 12 is cold rolled steel, but any suitable material can be used for surface 12, with the only requirement being that the surface attract a magnet.

Figure 3:
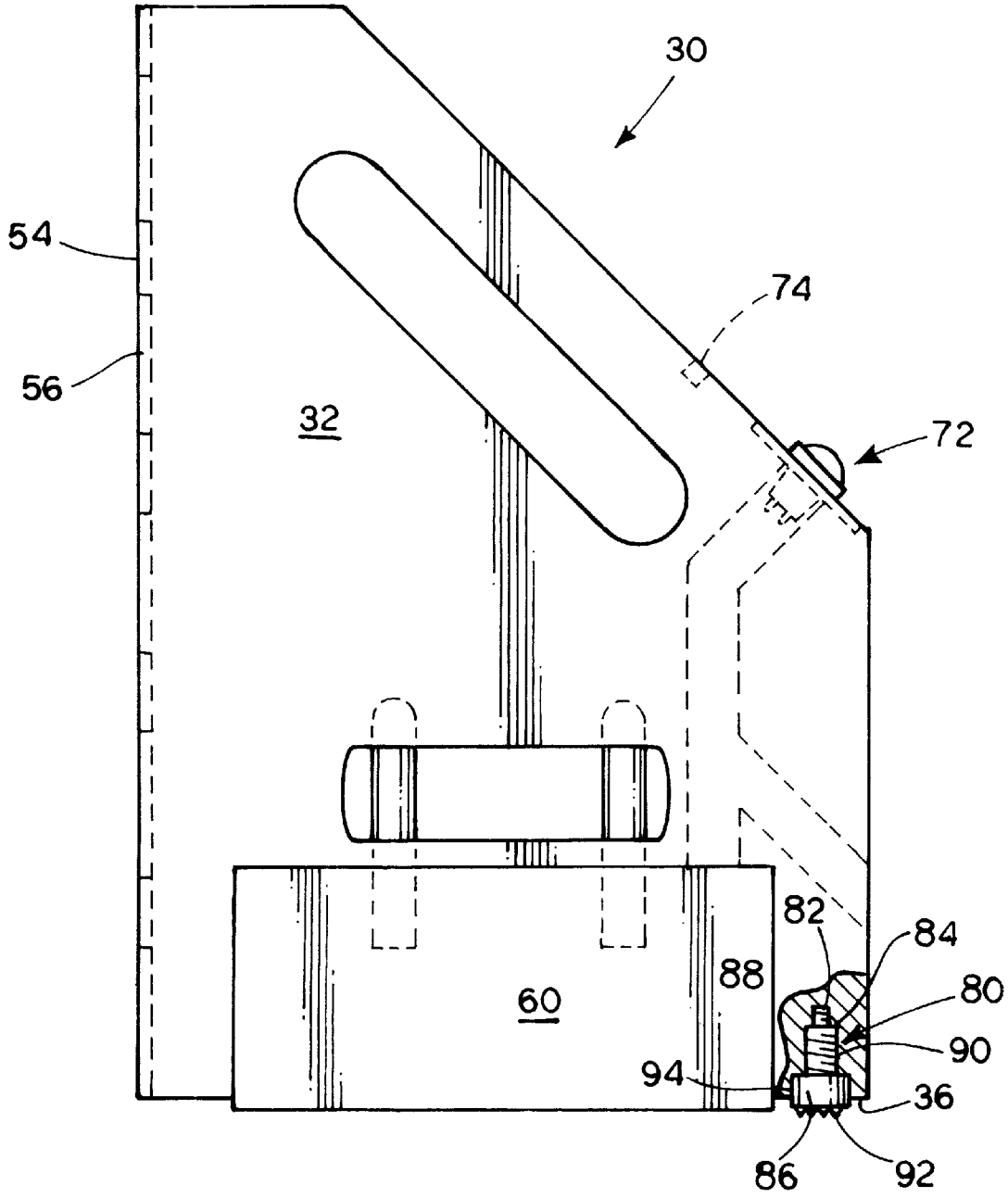
FIG. 3 is a side elevational view of a form block used in the unit of the present invention.
Figure 4:
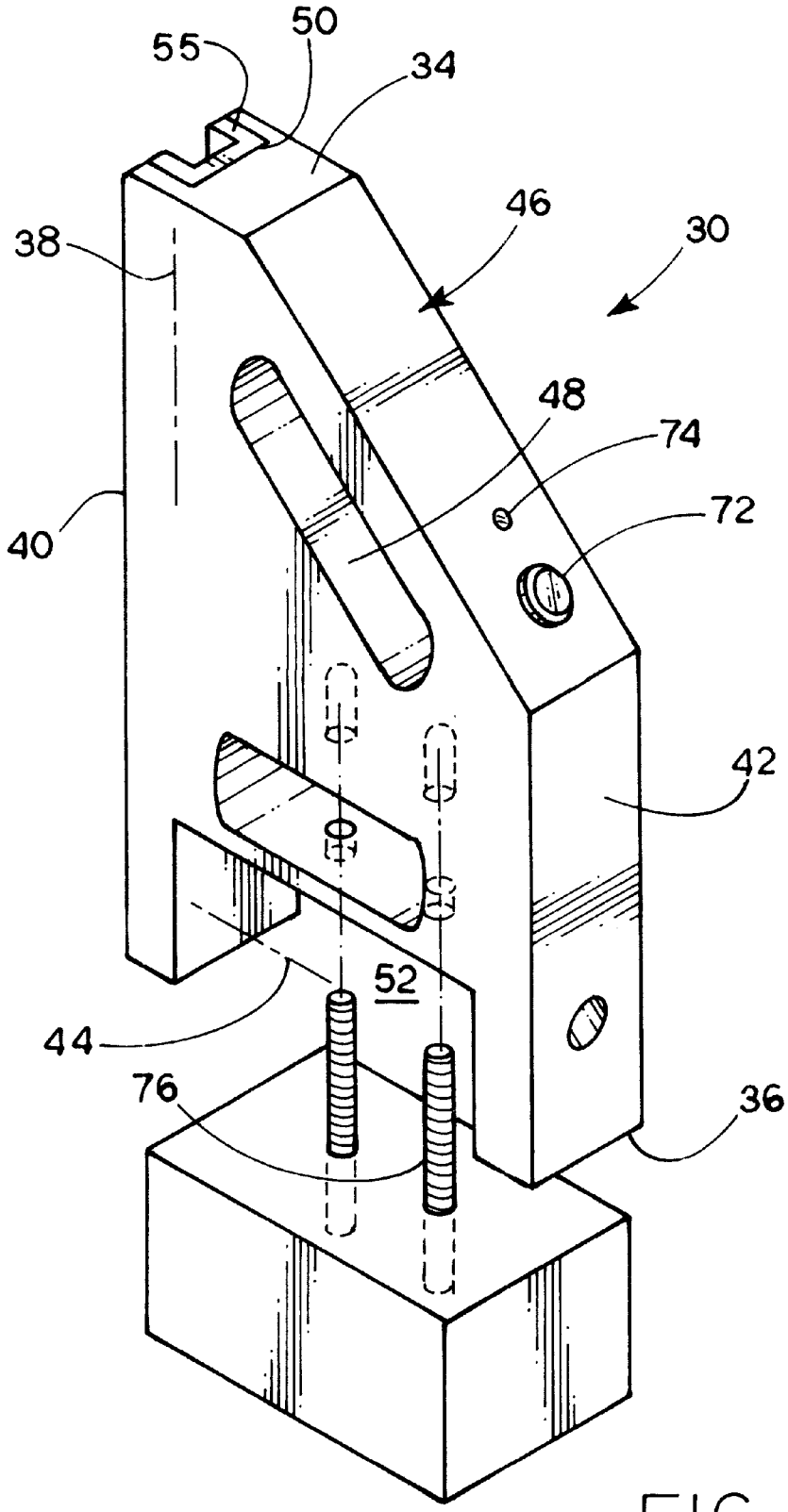
FIG. 4 is a perspective view of a form block used in the unit of the present invention with an electromagnet in position to be attached to that form block.

Unit 10 further includes a plurality of form blocks 30, best shown in FIGS. 3 and 4. All of the form blocks are identical, and each form block 30 includes an aluminum body 32 having a top 34, a bottom 36, a longitudinal axis 38 extending between top 34 and bottom 36 of body 32. Each form block 30 further includes a workpiece-engaging side 40 extending between top 34 and bottom 36 of body 32 of each form block 30, a second side 42 spaced from workpiece-engaging side 40 of each form block, a transverse axis 44 extending between workpiece-engaging side 40 and second side 42 of each form block, and a handle section 46 having an opening 48 through which a user places his or her hand to grip form block 30 to move that block. A channel 50 is defined in workpiece-engaging side 40 of each form block 30 and an electromagnet accommodating section 52 is defined in body 32 of each form block 30 adjacent to bottom 36 of each form block 30. A magnet-supporting base 54 is slidably received in channel 50 on workpiece-engaging side 40 of each form block 30, and a plurality of permanent magnets, such as permanent magnet 56, are magnetically fixed to magnet-supporting base 52 on each form block 30. The permanent magnets can be single magnets or a plurality of magnets stacked on base 52 at various locations. The magnets, or magnet stacks, are spaced apart from each other along longitudinal axis 38 of each form block 30. An electromagnet unit 60 is accommodated in electromagnet accommodating section 52 on each form block 30. The electromagnets are off-the-shelf items and thus will not be further discussed as one skilled in the art will understand what type of electromagnet will be best suited for unit 10. One form of the unit includes electromagnets having a strength sufficient to apply approximately three hundred pounds of shear force on the workpiece-supporting surface and nearly one thousand pounds of vertical pull on that surface when the magnet is activated. Thus, for thirteen units, the force will be approximately 3,900 pounds or 39,000 pounds total holding force with 13 pairs of blocks. It is noted that body 32 is formed of aluminum to be light weight as well as durable and, as will be understood from the teaching of this disclosure, to have heat transfer properties that assist transferring heat from electromagnet unit 60 to a workpiece during a bending process.

Unit 10 further includes an electric control circuit 70 (see FIG. 2) which electrically connects electromagnet unit 60 in each form block 30 to a power source (not shown), such as power from an electrical wall outlet, which can be one hundred ten volts or the like. Control circuit 70 which includes an on/off switch 72 mounted on each form block 30 in electronic control circuit 70 of each electromagnet unit 60 of each form block and mounted on the body of each electromagnet unit 60 of each form block, and an on/off indicator 74 in electronic control circuit 70 of each electromagnet unit of each form block 30 and mounted on body 32 of each electromagnet unit of each form block 30. Fasteners, such as threaded fastener 76, fasten electromagnet unit 60 of each form block 30 to body 32 of each form block 30.

A friction unit 80 (see FIG. 3) is movably mounted on bottom 36 of body 32 of each form block 30 and includes a blind-ended bore 82 defined in body 32 of each form block 30 and extends from bottom 36 of body 32 of each form block 30 along longitudinal axis 38 of the body of each form block toward top 34 of the body of each form block. Friction unit 80 further includes a screw thread 84 defined in body 32 of each form block 30 adjacent to blind-ended bore 82 of friction unit 80, a friction element 86 having a body 88 with a screw thread 90 thereon that engages screw thread 84 on body 32 of each form block adjacent to blind-ended bore 82 of friction unit 80 and a friction head 92 on body 88 of friction element 86 of friction unit 80, and a counter-bore 94 defined in body 30 of each form block 30 adjacent to blind-ended bore 82 of friction unit 80. Friction head 92 of friction element 86 of the friction unit is movable in blind-ended bore 82 and in counter-bore 94 of friction unit 80 on each form block between a workpiece-surface engaging position shown in FIG. 3 and a stored position in which friction head 92 is located inside counter bore 94 to be spaced apart from any surface on which bottom 36 of the form block rests. Friction head 92 frictionally engages workpiece-supporting surface 12 when the friction element is in the workpiece-supporting surface engaging position and the form block on which the friction unit is mounted is located on said workpiece-supporting surface. When friction head 92 is in the workpiece-supporting surface engaging position shown in FIG. 3, the form block must be physically lifted above surface 12 in order to move that form block. Thus, any force exerted on workpiece-engaging side 40 must be sufficient to actually lift the form block off of surface 12. In some cases, this force must exceed one thousand pounds per form block, which is considerable. Simple shear forces may not be sufficient to achieve this effect. Thus, with the friction head in the FIG. 3 position, the form block is extremely stable. A simple screwing motion will move the friction head into and out of counterbore 82.

Figure 5:
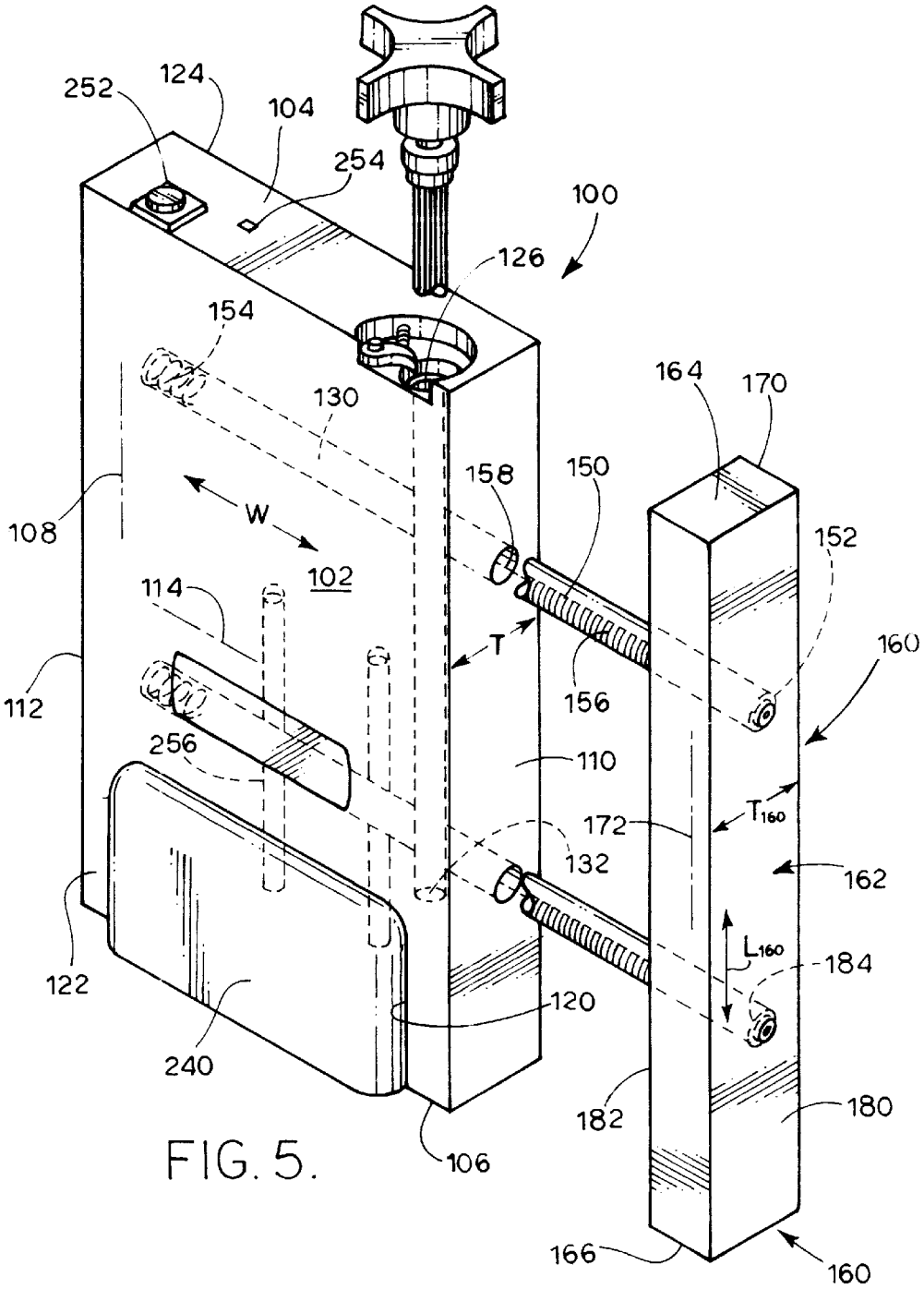
FIG. 5 shows a clamp block used in the unit of the present invention.

Unit 10 further includes a plurality of aluminum clamp blocks, such as clamp block 100 (see FIG. 5). The clamp blocks are all identical, and each clamp block includes a body 102 which includes a top 104, a bottom 106, a longitudinal axis 108 extending between top 104 of each clamp block 100 and bottom 106 of each clamp block 100, a first side 110, a second side 112, a transverse axis 114 extending between first side 110 and second side 112 of each clamp block 100. Each clamp block body further includes an electromagnet accommodating section 120 defined in body 102 of each clamp block 100 adjacent to bottom 106 of each clamp block 100, a front surface 122, and a rear surface 124. A longitudinally extending blind-ended bore 126 is defined from top 104 of body 102 of each clamp block toward bottom 106 of body 102 of each clamp block along longitudinal axis 108 of the body of each clamp block. Bore 126 is located between front surface 122 and rear surface 124 of body 102 of each clamp block and is located near first side 110 of the body of each clamp block. Each clamp block further includes two transversely extending blind-ended bores 130 and 132 defined from first side 110 of body 102 of each clamp block toward second side 112 of body 102 of each clamp block along transverse axis 114 of body 102 of each clamp block and is located between front surface 122 and back surface 124 of body 102 of each clamp block. The transversely extending bores 130 and 132 are located to intersect longitudinally extending blind-ended bore 126 defined in the body of each clamp block and are spaced apart from each other along longitudinal axis 108 of the body of each clamp block. Each clamp block has a width W measured between first side 110 and second side 112 of the body of each clamp block, a length L measured between top 104 and bottom 106 of the body of each clamp block, and a thickness T measured between front surface 122 and rear surface 124 of the body of each clamp block. As discussed above, clamp block 100 is formed of aluminum for the heat transfer properties and weight characteristics thereof as well as for the other features discussed above with reference to the form blocks.

Each clamp block further includes a rack 150 which can include teeth or the like and which is located in each of the two transversely extending blind-ended bores defined in the body of each clamp block. Each rack 150 extends out of the transversely extending blind-ended bore and has a distal end 152 located outside of the transversely extending blind-ended bore and a proximal end 154 located inside the transversely extending blind-ended bore. The racks include teeth or threads 156 or the like and remain inside the blind-ended bores during use. The racks move along their longitudinal axes 158 which extend from the distal end of each rack to the proximal end of that rack.

Each clamp block further includes a workpiece-engaging element 160 mounted on distal ends 152 of the two racks 150 of each clamp block 100 and include a body 162 having a top end 164 located adjacent to top 104 of body 102 of the clamp block on which the workpiece-engaging element is mounted, a bottom end 166 located adjacent to bottom 106 of body 102 of the clamp block on which the workpiece-engaging element is mounted, a front side 168 located adjacent to front surface 122 of body 102 of the clamp block on which the workpiece-engaging element is mounted, a rear side 170 located adjacent to rear surface 124 of body 102 of the clamp block on which the workpiece-engaging element is mounted, and a longitudinal axis 172 extending from top end 164 of body 162 of workpiece-engaging element 160 to bottom end 166 of workpiece-engaging element 160. Workpiece-engaging element 160 has a-length $L_{160}$ which is essentially equal to length L of body 102 of the clamp block on which the workpiece-engaging element is mounted, and a thickness $T_{160}$ that is essentially equal to thickness T of body 102 of the clamp block on which the workpiece-engaging element is mounted. Each workpiece-engaging element 160 further includes a workpiece-engaging surface 180, a second surface 182 located adjacent to first side 110 of body 102 of the clamp block on which the workpiece-engaging element is mounted, and two rack distal end receiving blind-ended bores 184 defined in body 162 of each workpiece-engaging element 160 from second surface 182 of body 162 of each workpiece-engaging element 160 toward the workpiece engaging surface 180 of body 162 of the workpiece-engaging element. Distal ends 152 of each of the racks being accommodated in the one of the rack distal end receiving blind-ended bores to attach each workpiece-engaging element to the body of one clamp block of the plurality of clamp blocks.

As can be understood from the foregoing, movement of the rack along its longitudinal axis 158 toward or away from body 102 will move workpiece-engaging element 160 toward or away from body 102. The purpose of such movement will be understood from the teaching of this disclosure.

Figure 6:
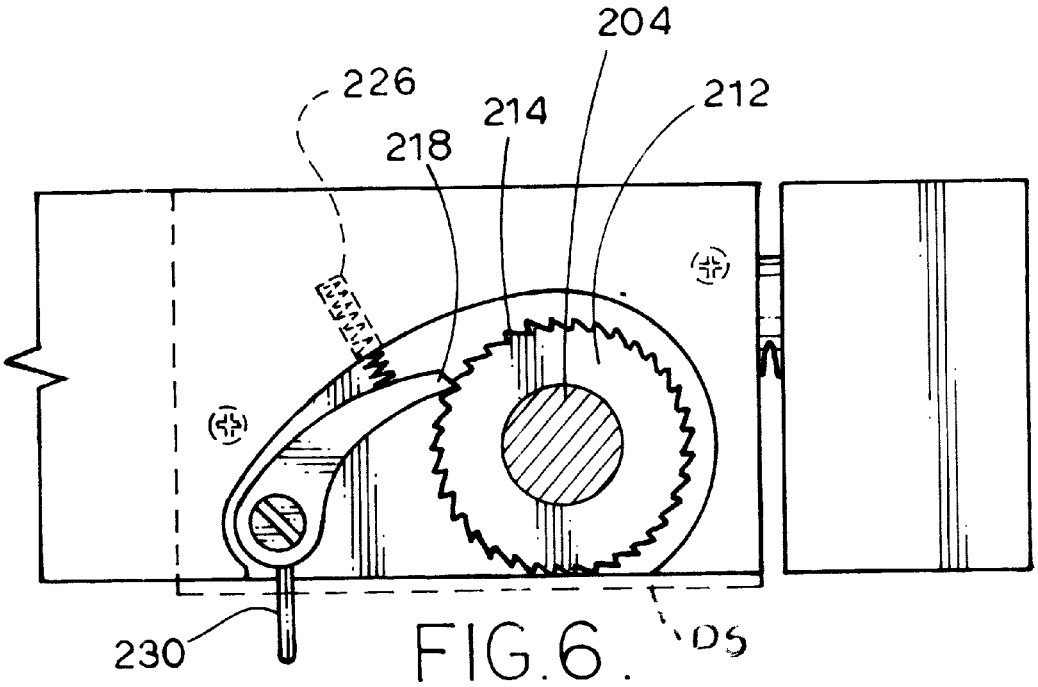
FIG. 6 is a top plan view of a lock used on the form blocks of the present invention.
Figure 7:
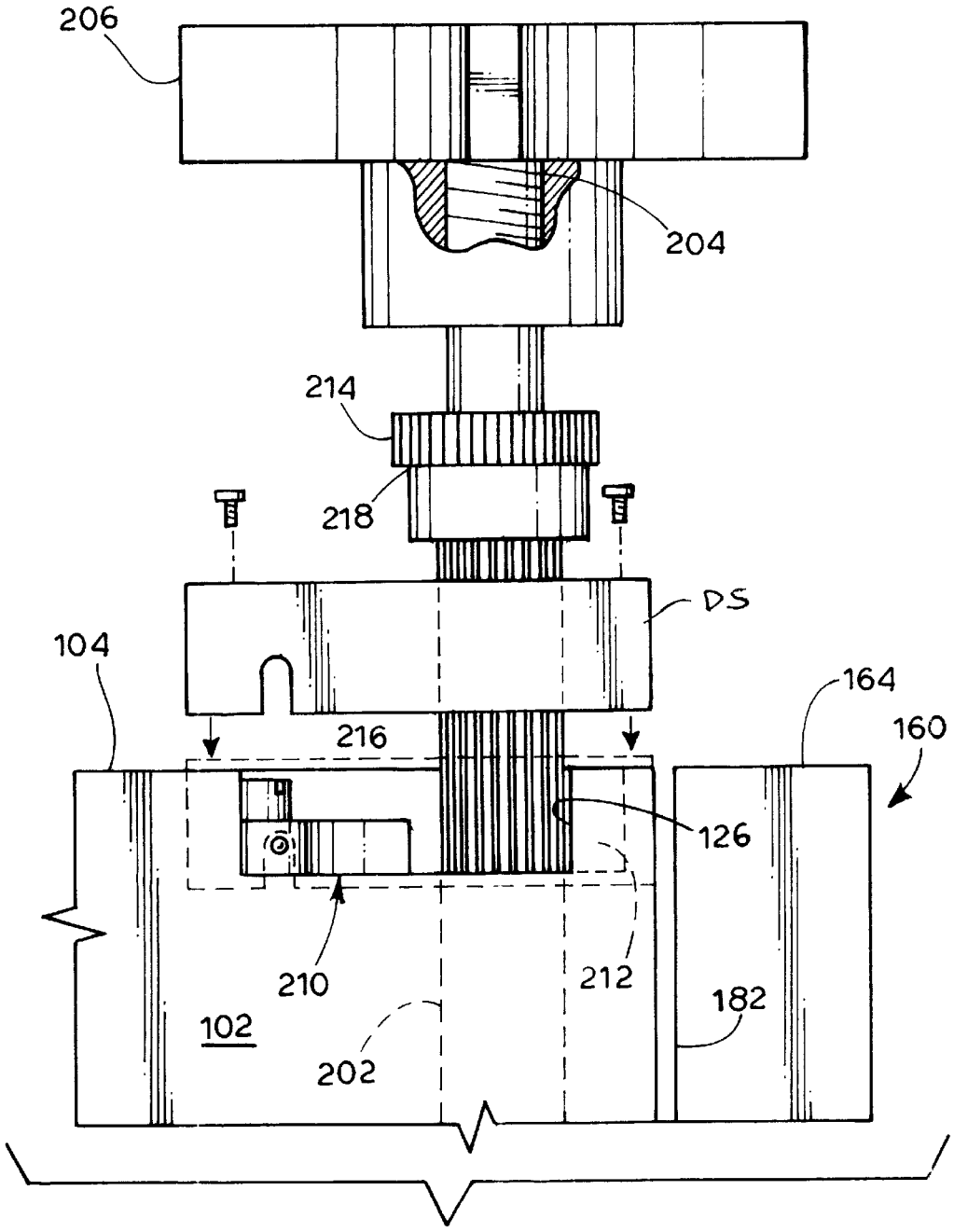
FIG. 7 is a side view of a portion of a pinion unit of a form block of the present invention.
Figure 8:
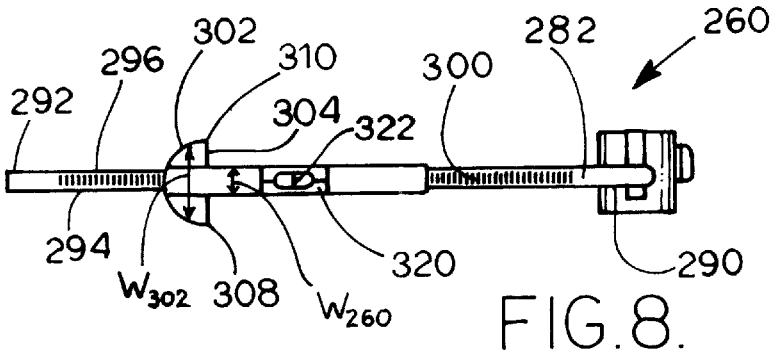
FIG. 8 is a top plan view of a trammel used in the unit of the present invention.
Figure 9:
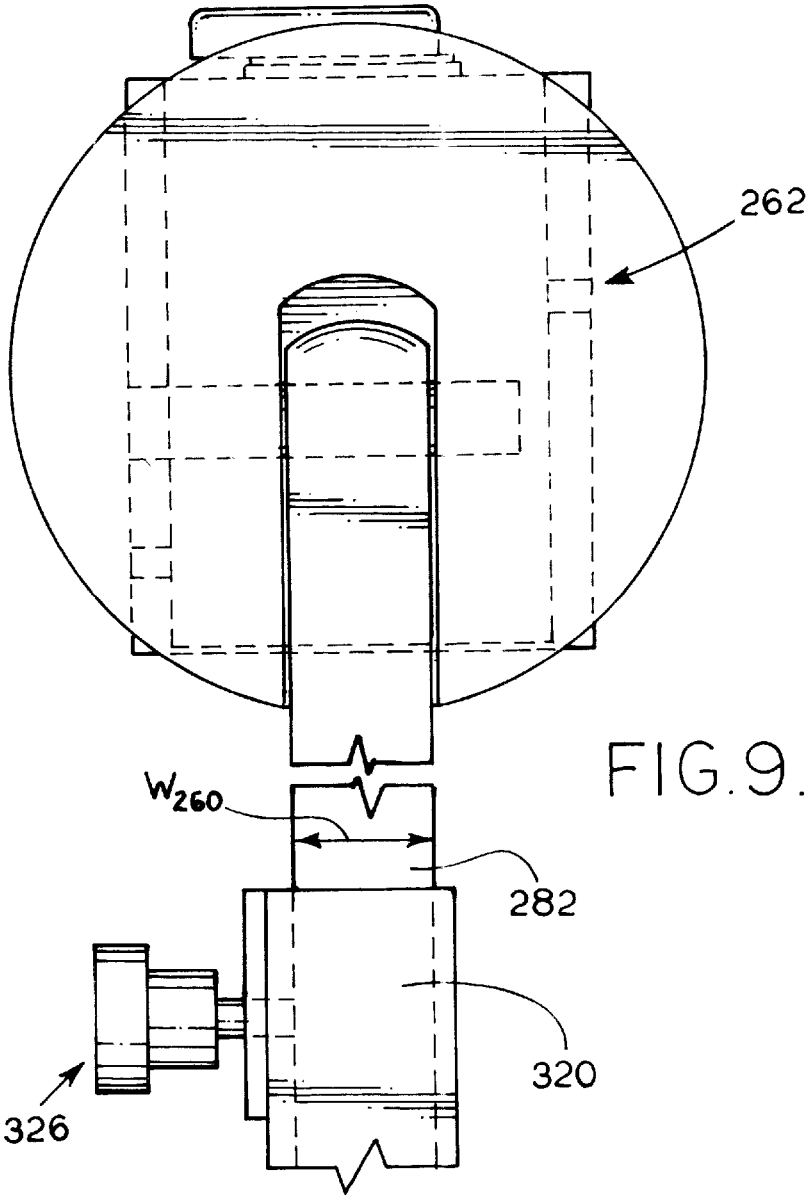
FIG. 9 is a top plan view of a base used to fix the trammel to a workpiece-supporting surface of the unit of the present invention.
Figure 10:
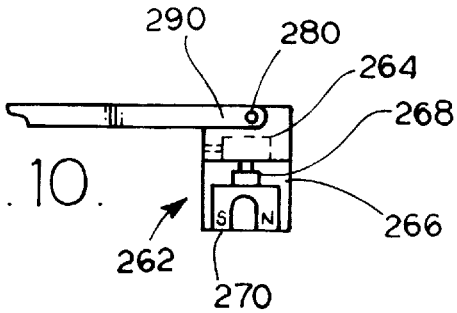
FIG. 10 is a side elevational view of the base for the trammel.
Figure 11:
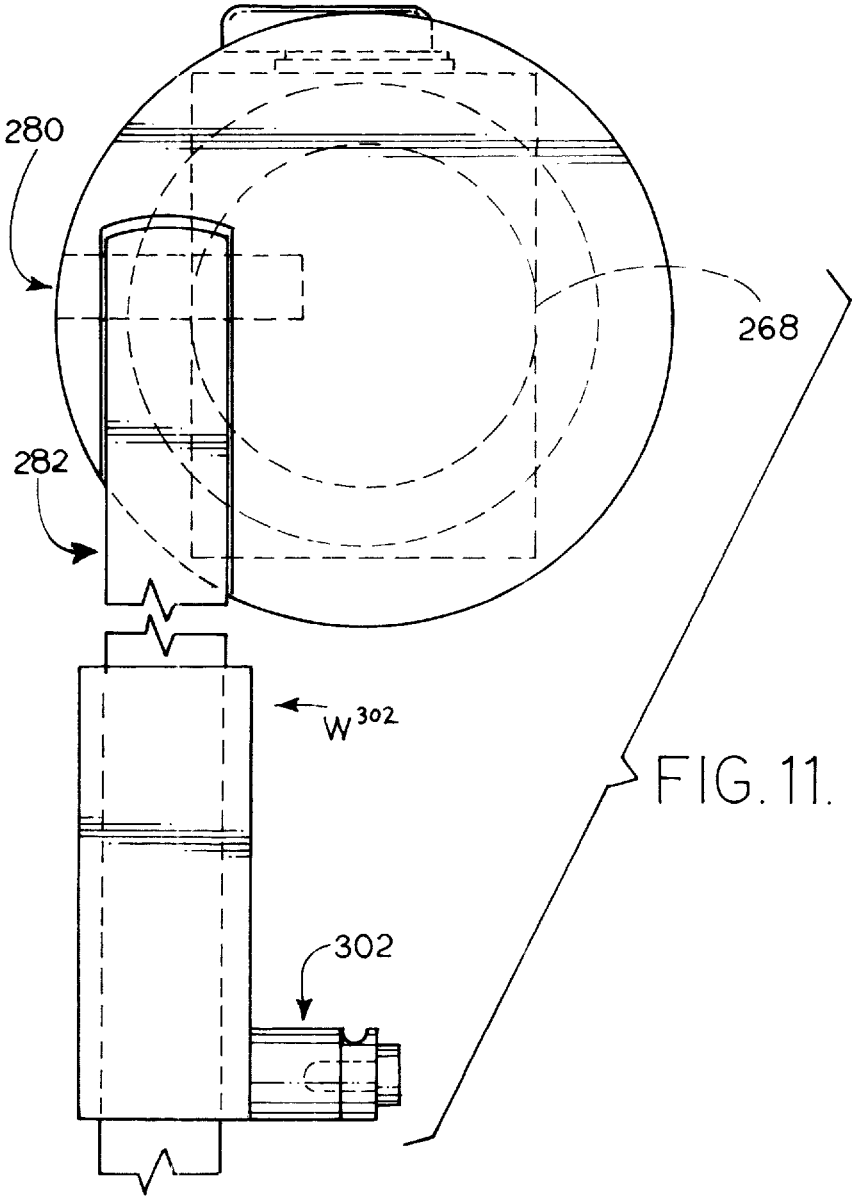
FIG. 11 is a top plan view of a stop element used on the trammel to set locations for form blocks on a workpiece-supporting surface.

Each clamp block further includes a pinion unit 200 shown in FIGS. 5–7. All of the pinion units are identical and each has an elongated pinion gear 202 located in longitudinally extending blind-ended bore 126 defined in the body of each clamp block and intersects both of the two transversely extending blind-ended bores 130 and 132 defined in the body of each clamp block and engages the rack in each of the two transversely extending blind-ended bores defined in the body of each clamp block. A distal end 204 on the elongated pinion gear is positioned outside of longitudinally extending blind-ended bore 126 defined in the body of each clamp block, and a handle 206 is fixed on distal end 204 of elongated pinion gear 202. Elongated pinion gear 202 meshingly engages the racks to move those racks into and out of the transversely extending blind-ended bores defined in the body of each clamp block as the handle is rotated to move the workpiece-engaging element toward and away from the body of the clamp block on which the workpiece-engaging element is located. A lock 210 (best shown in FIGS. 6 and 7) is located on top 104 of body 102 of each clamp block and engages elongated pinion gear to prevent retrograde rotation of the elongated pinion gear when the lock is engaged with the elongated pinion gear. Lock 210 includes a gear 212 having gear teeth 214 fixedly mounted on elongated pinion gear 202 for rotation therewith, a dog element 216 pivotally mounted on body 102 of the clamp block and has a distal end 218. Dog element 216 is movable between a rotation permitting position indicated in dotted lines in FIG. 6 with distal end 218 spaced from gear teeth 214 of gear 212 of lock 210 and a rotation preventing position shown in full lines in FIG. 6 with distal end 218 engaging gear teeth 214 of gear 212 of lock 210. A biasing element 226 is mounted on body 102 of the clamp block 100 and engages dog element 216 and biases dog element 216 into the rotation preventing position. A release element 230 is mounted on body 102 of the clamp block and engages dog element 216 to move dog element 216 into the rotation permitting position when release element 230 is manually activated.

An electromagnet 240 is accommodated in electromagnet accommodating section 120 defined in body 102 of each clamp block adjacent to bottom 106 of each clamp block. An electric control circuit 250 (see FIG. 2) electrically connects electromagnet 240 in each clamp block to a power source, such as the power source discussed above and includes an on/off switch 252 in the electronic control circuit of each electromagnet of each clamp block and which is mounted on the body of each clamp block, and an on/off indicator 254 in the electronic control circuit of each electromagnet of each clamp block and which is mounted on the body of each clamp block. Fasteners, such as fastener 256, fasten the electromagnet 240 of each clamp block to the body of each clamp block.

The elements of the electric control circuits, including the on/off switches, the on/off indicators, the electrical connectors, as well as any and all circuit elements and controllers are, themselves, all off-the-shelf items and thus will not be further discussed as those skilled in the art will be able to select the appropriate items based on the teaching of this disclosure. A dust cover DC is also shown in FIGS. 6 and 7.

Unit 10 further includes a trammel 260 (best shown in FIGS. 8–11) which includes a base 262 having a top section 264, a bottom section 266, a rotatable connection 268 connecting top section 264 to bottom section 266 so top section 264 will rotate with respect to bottom section 266, and a permanent magnet 270 in bottom section 266 of base 262 of trammel 260. Trammel 260 is mounted on workpiece-supporting surface 12 by permanent magnet 270 of trammel 260. A pivot element 280 is located on top section 264 of base 262 of trammel 260. Trammel 260 further includes a trammel arm 282 having a proximal end 290 pivotally connected to pivot element 280 of base 262 of trammel 260, a distal end 292, and two side edges 294 and 296 that extend from distal end 292 of trammel arm 282 to proximal end 290 of trammel arm 282. Trammel arm 282 has a width dimension $W_{260}$ extending between two side edges 294 and 296 of trammel arm 260. A multiplicity of markings, such as marking 300 are located on trammel arm 260. A stop element 302 is slidably mounted on trammel arm 260 to move toward and away from distal end 292 of trammel arm 260 and has a rear edge 304 that extends along width dimension $W_{260}$ of trammel arm 282 and which has a width dimension $W_{2302}$ which is greater than width dimension $W_{260}$ of trammel arm 282. Stop element 302 is held in place on trammel arm 260 by friction. Stop element 302 can thus be slidably moved on the trammel arm to a desired location on the trammel arm and then will remain in the desired location because of the frictional engagement between stop element 302 and trammel arm 260. Stop element 302 further includes ends 308 and 310 on rear edge 304 of stop element 302 of trammel 260 that are spaced apart from side edges 294 and 296 of trammel arm 282 with rear edge 304 of stop element 302 of trammel arm 282 extend away from side edges 294 and 296 of trammel arm 282 when stop element 302 is mounted on trammel arm 282.

A sight gauge 320 is slidably mounted on trammel arm 282 to move toward and away from distal end 292 of trammel arm 282 and has a gauge mark 322 thereon which is located to be aligned with one of markings 300 on trammel arm 282 when sight gauge 320 is mounted on trammel arm 282. Sight gauge 320 is held in place by frictional engagement with trammel arm 260. Thus, the sight gauge can be moved into the desired location on the trammel arm, and then will remain in that location due to frictional engagement with the trammel arm. A lock 326 is on sight gauge 320 of trammel arm 282 to lock sight gauge 320 in place on trammel arm 282.

When trammel arm 282 is mounted on base 262 of trammel 260 and base 262 is mounted on workpiece-supporting surface 12, trammel arm 282 is rotatable in a plane that is parallel to workpiece-supporting surface 12 and trammel arm 282 is pivotable in a plane that is upright with respect to workpiece-supporting surface 12.

Figure 16:
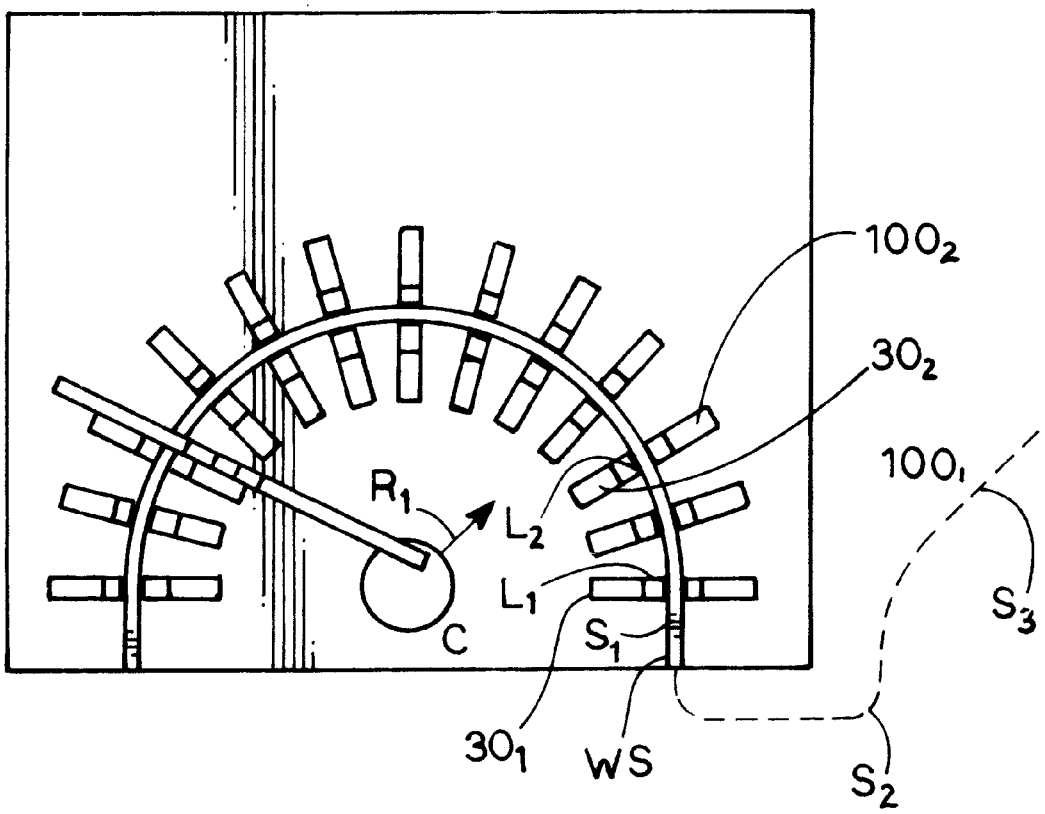
FIG. 16 is a schematic showing a unit embodying the teaching of the present invention with a continuous and uninterrupted curve.

Rear edge 304 of stop element 302 of trammel arm 282 is movable with the trammel arm as trammel arm 282 is moved over workpiece-supporting surface 12 along an arc with a center of curvature defined at base 262 and a radius defined by the distance along trammel arm 282 between rear edge 304 of stop element 302 and defines a continuous and uninterrupted path 350 (see FIG. 16) over workpiece-supporting surface 12 when trammel arm 282 is rotated about base 262 of trammel arm 282. By moving base 262, a compound curve such as curve 350–352 shown in FIG. 16 can be defined. As will occur to those skilled in the art based on the teaching of this disclosure, any form of curve can be defined from the simple arc shown in FIG. 16, to a compound arc with arches and the like. By attaching a marker to stop element 302, the curve can be actually drawn on workpiece-supporting surface 12. However, as can also be understood from the foregoing, rotation of the trammel arm can be stopped at any time to mark any particular location desired. The continuous and uninterrupted nature of the path traversed by the trammel arm enables a user to identify any and all positions along the path. Stop element 302 on trammel arm 282 defines a form block location at any location along the continuous and uninterrupted path. A form block 30 can be placed at each form block location. Once the form block is placed on the workpiece-supporting surface, the trammel arm is pivoted up and over that placed form block and pivoted to the next desired location for placement of the next form block. As discussed above, clamp blocks are placed adjacent to the path and adjacent to placed form blocks as indicated in FIG. 16. Once all of the form and clamp blocks have been placed in the desired positions, the electric control circuit 70 can be activated, either with a single control button or by operating each on/off switch on each form and clamp block to activate the electromagnets in each of the form and clamp blocks to securely fix the form and clamp blocks to the workpiece-supporting surface.

Once the form and clamp blocks are all in place, the workpiece can be placed between selected ones of the form and clamp blocks, the workpiece clamped between such selected blocks and then forced into the adjacent form and clamp blocks to bend the workpiece in a manner that will be understood by those skilled in the art based on the teaching of this disclosure. Once the workpiece has been clamped as desired, a thermal element, such as a blanket or the like can be placed over some or all of the form and clamp blocks. This thermal element controls the temperature of the workpiece as it is being bent and any adhesive is setting up. The aluminum blocks will pass heat from the electromagnets into the area adjacent to the blocks, and such heat can be directed and controlled to assist in the set-up time or glue time process for the workpiece. A thermal element TE is indicated in FIG. 1.

Unit 10 includes a magnetically attractive workpiece-engaging support 350 (see FIG. 1) engaging the permanent magnets in the workpiece-engaging side of the form blocks.

Figure 1:
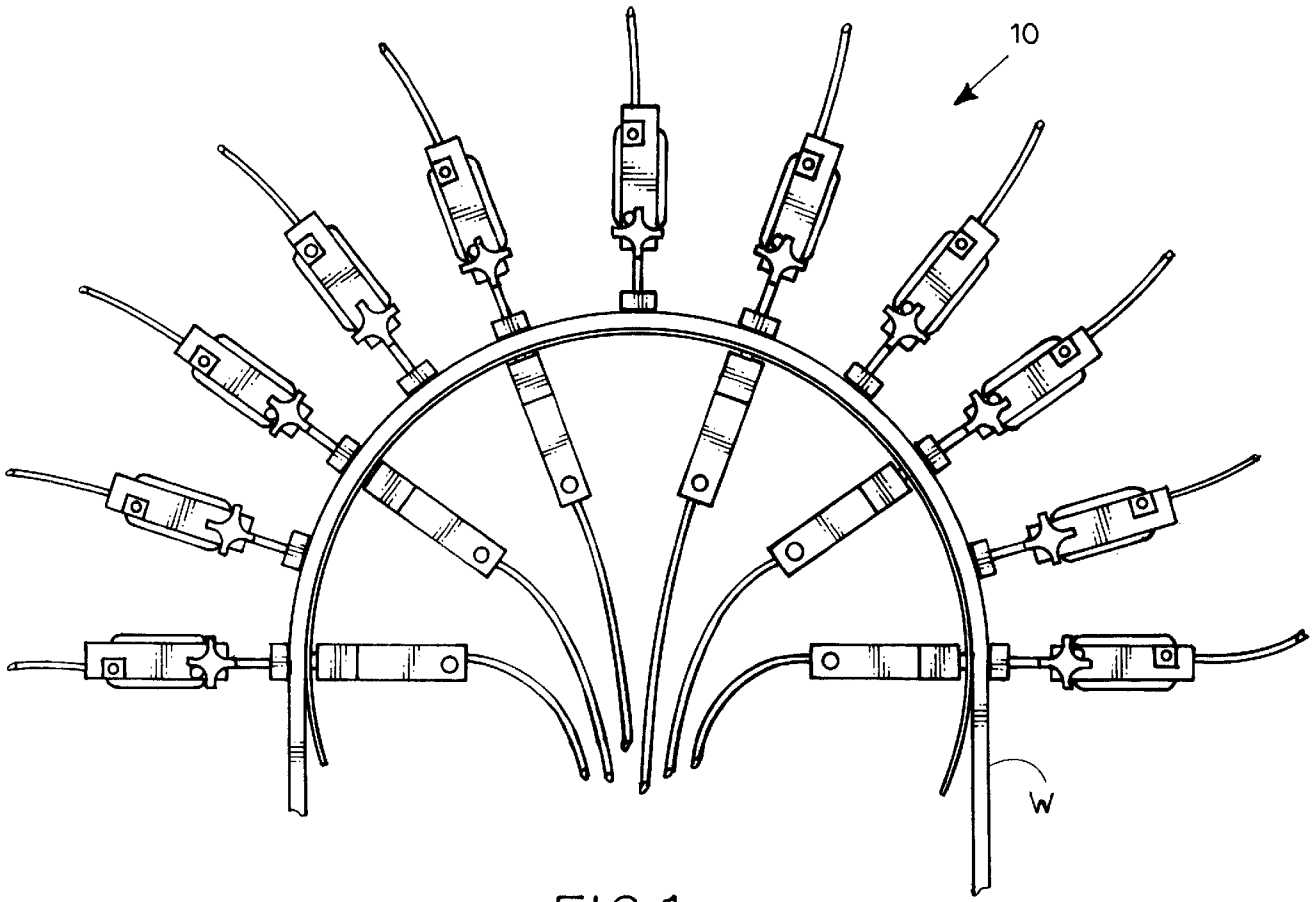
FIG. 1 is a perspective view of a unit embodying the teaching of the present invention with a workpiece therein.

As can be seen in FIG. 1, one form of unit 10 includes additional clamp blocks, such as additional clamp block 100', that are located between adjacent clamp blocks and are spaced from adjacent form blocks. This adds control to the bending process.

Referring to FIG. 16, a method for bending wood into arcuate shapes embodying the teaching of the present invention comprises: providing planar magnetically attractive workpiece-supporting surface 12 at any suitable location, such as in a workshop or the like; locating a center of curvature C for a first arcuate section S1 of a wood arcuate shape WS which can be simple or compound with a plurality of sections, such as section S2 or S3 with one or more of such sections being arch shaped such as indicated for section S3. The arcuate sections S1 . . . SN are paths and can be lines on workpiece-supporting surface 12. The wood workpiece will be bent into a shape that follows these paths during the process disclosed herein. Paths S1 . . . SN are continuous and uninterrupted so that form blocks and clamp blocks can be located at any and all locations along a path. The process is continued by placing permanent magnet 270 at center of curvature C for first arcuate section S1, pivotally and rotatably attaching trammel 260 to permanent magnet 270, selecting a continuous and uninterrupted first radius of curvature for first arcuate section S1, identifying a first radius of curvature R1 on trammel 260 by setting stop element 302 in step 510, rotating trammel 260 in a plane that is parallel to a plane containing planar workpiece-supporting surface 12, defining continuous and uninterrupted arcuate curve S1 over workpiece-supporting surface 12 using trammel 260, and identifying a first location, such as location L1, on workpiece-supporting surface 12 on arcuate curve S1 using the trammel. Location L1 can be any convenient location along curve S1 and the location shown in FIG. 16 is merely for the purposes of illustration and is not intended to be limiting. The process is continued by placing a first form block $\mathbf{30}_1$, at first location L1 on workpiece-supporting surface 12, electro-magnetically fixing first form block $\mathbf{30}_1$, to workpiece-supporting surface 12 at first location L1 on workpiece-supporting surface 12. A workpiece-engaging side 40 of first form block $\mathbf{30}_1$, is oriented to be upright with respect to workpiece-supporting surface 12 and a permanent magnet 56 of the first form block is attached to the workpiece-engaging side 40 of first form block $\mathbf{30}_1$. Trammel arm 282 of trammel 260 is rotated in the plane parallel to the plane containing the workpiece-supporting surface along continuous and uninterrupted path S1 over the workpiece-supporting surface to a second location on path Si on the workpiece-supporting surface. The first and second locations on path S1 are indicated in FIG. 16 by L1 and L2, but can be any desired location on path S1 with locations L1 and L2 being shown merely for illustration purposes and not for limitation purposes. The process is continued by placing a second form block 302 at second location L2 on path S1 on workpiece-supporting surface 12. Second form block $\mathbf{30}_2$ is electromagnetically fixed to the workpiece-supporting surface at second location L2 on the workpiece-supporting surface. It is noted that the electromagnetic fixing of the form blocks can occur when the blocks are initially located or can occur after all of the form blocks are located. The form blocks can be fixed individually or simultaneously as discussed above using electric control circuit 70. A workpiece-engaging side 40 of second form block $\mathbf{30}_2$ is oriented to be upright with respect to the workpiece-supporting surface in, and a permanent magnet 56 of the second form block is attached to the workpiece-engaging surface of the second form block. The trammel rotating, the form block placing, the form block fixing, the workpiece-engaging surface orienting and the electro-magnetically fixing steps are repeated until a plurality of form blocks have been placed on the workpiece-supporting surface at any and all desired locations on the continuous and uninterrupted arcuate curve S1 over the workpiece-supporting surface.

After a laminated element or the like is on a form block against a steel form band, the process is then continued in step 540 by placing a first clamp block $\mathbf{100}_1$ on the workpiece-supporting surface adjacent to the continuous and uninterrupted arcuate curve S1 over the workpiece-supporting surface and adjacent to the workpiece-engaging side 40 of first form block $\mathbf{30}_1$, electromagnetically fixing first clamp block $\mathbf{100}_1$ to the workpiece-engaging surface, orienting a workpiece-engaging element 160 of first clamp block 1001 to be parallel to workpiece-engaging side 40 of first form block $\mathbf{30}_1$, placing a second clamp block $\mathbf{100}_2$ on, the workpiece-supporting surface adjacent to continuous and uninterrupted arcuate curve S2 over the workpiece-supporting surface and adjacent to workpiece-engaging side 40 of second form block $\mathbf{30}_2$ electromagnetically fixing second clamp block $\mathbf{100}_2$ to the workpiece-engaging surface, and orienting a workpiece-engaging element 160 of second clamp block $\mathbf{100}_2$ to be parallel to the workpiece-engaging side 40 of second form block $\mathbf{30}_2$. The steps of clamp block placing, clamp block electromagnetic fixing and workpiece-engaging element orienting steps for each form block are repeated as indicated in step 552 until all of the desired clamp blocks are placed.

Figure 2:
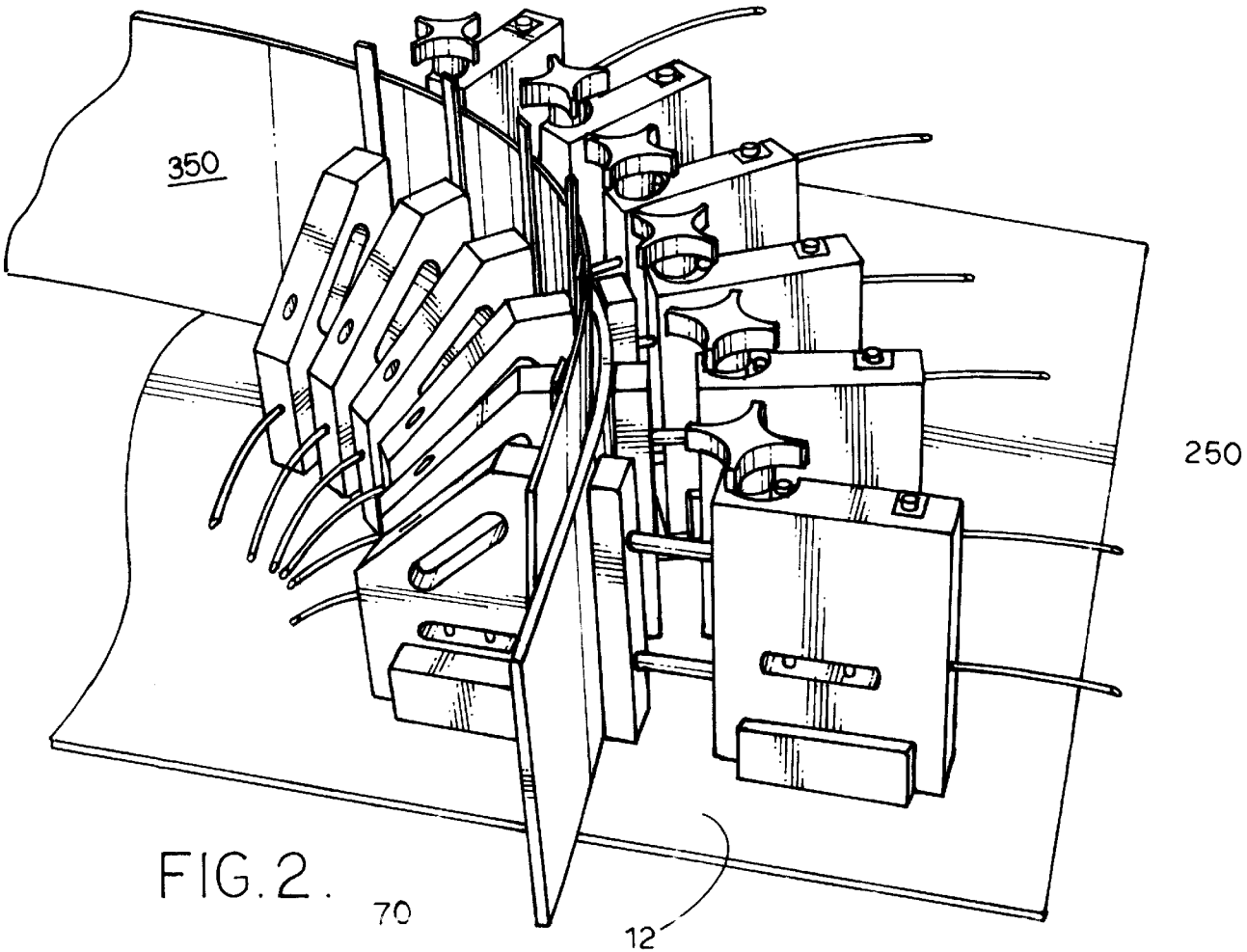
FIG. 2 is a perspective view of a portion of a unit embodying the teaching of the present invention with a workpiece therein.

The process is continued by placing magnetically attractive workpiece-engaging support 350, such as a steel plate, such as blue tempered spring steel, or the like, shown in FIG. 2, against the permanent magnets in the workpiece-engaging surface of the electromagnetically fixed form blocks, placing a wood workpiece W such as shown in FIG. 1 and which can be laminated, against the magnetically.attractive workpiece-engaging support, moving a workpiece-engaging element of one clamp block of the plurality of clamp blocks into contact with the wood workpiece, securely clamping the wood workpiece between the moved workpiece-engaging element of the one clamp block and the workpiece-engaging surface of the form block adjacent to the one clamp block, locking the workpiece-engaging element of the one clamp block in a workpiece clamping position, and repeating the steps of workpiece-engaging element moving and the secure clamping of the wood workpiece and the locking of the workpiece-engaging element until the workpiece has been securely clamped between all the form blocks and clamp blocks located on the first arcuate section.

The just-described method can be continued for other shapes and portions of the overall curved workpiece as indicated by locating a center of curvature for a second arcuate section and repeating the steps disclosed above for the second arcuate section.

The above-described method can also includes steps of placing a clamp block between adjacent form blocks, electromagnetically fixing the further clamp block to the workpiece-supporting surface, orienting a workpiece-engaging element of the further clamp block to be upright with respect to the workpiece-supporting surface, and moving the workpiece-engaging element of the further clamp block into contact with the wood workpiece as indicated.

As indicated the wood workpiece can be laminated.

In some instances, the shear force exerted by the workpiece on the form and clamp blocks may be extremely high. In such instances, the friction unit 80 on any or all of the form blocks can be used and the method will include frictionally engaging one of the form blocks with the workpiece-supporting surface.

As also discussed above, some processes will utilize the heat generated by the electromagnets to assist the setting up of the adhesive, and such processes will include thermally connecting the electromagnetically fixed form blocks to the electromagnetically fixed clamp blocks and to the wood workpiece.

As above discussed, the method of the present invention can include locating a center of curvature for each of a plurality of arcuate sections and repeating the above-disclosed steps for each arcuate section of the plurality of arcuate sections.

As mentioned above, the method of the present invention can have the step of electromagnetically fixing the form and clamp blocks to the workpiece-supporting surface occur individually.

Industrial Application

The above-described apparatus and method can be used for a wide variety of applications, including, but not limited to, the fabrication of baseboards, chair rails, crown molding, plate rails, soffit, frieze molding, window aprons, window trim, window headers, window jambs, door trim, door headers, door jambs, window sashes, cabinet frames, counter edges, passage door elements, cabinet door elements, bar tops, column bases, column elements, including capitols, stair components, mitered elements, beams, paneling and the like. Arch shapes as well as smooth curves and combinations thereof can be formed. All sorts of laminated products can be formed using the above-described invention.

It is understood that while certain forms of the present invention have been illustrated and described herein, it is not to be limited to the specific forms or arrangements of parts described and shown.

What is claimed is:

1. A unit for bending wood into arcuate shapes comprising:

D) a planar magnetically attractive workpiece-supporting surface;

E) a plurality of form blocks, each of which includes (1) an aluminum body having (a) a top, (b) a bottom, (c) a longitudinal axis extending between the top and the bottom of the body of each form block, (d) a workpiece-engaging side extending between the top and the bottom of the body of each form block, (e) a second side spaced from the workpiece-engaging side of each form block, (f) a transverse axis extending between the workpiece-engaging side and the second side of each form block, (g) a handle section, (h) a channel defined in the workpiece-engaging side of each form block, and (i) an electromagnet accommodating section defined in the body of each form block adjacent to the bottom of each form block, (2) a magnet-supporting base slidably received in the channel on the workpiece-engaging side of each form block, (3) a plurality of permanent magnets magnetically fixed to the magnet-supporting base in each form block, the permanent magnets being spaced apart from each other along the longitudinal axis of each form block, (4) an electromagnet unit accommodated in the electromagnet accommodating section on each form block, (5) an electric control circuit electrically connecting the electromagnet unit in each form block to a power source, which includes (a) an on/off switch in the electronic control circuit of each electromagnet unit of each form block and mounted on the body of each electromagnet unit of each form block, and (b) an on/off indicator in the electronic control circuit of each electromagnet unit of each form block and mounted on the body of each electromagnet unit of each form block, (6) fasteners fastening the electromagnet unit of each form block to the body of each form block, and (7) a friction unit movably mounted on the bottom of the body of each form block and which includes (a) blind-ended bore defined in the body of each form block and extending from the bottom of the body of each form block along the longitudinal axis of the body of each form block toward the top of the body of each form block, (b) a screw thread defined in the body of each form block adjacent to the blind-ended bore of the friction unit, (c) a friction element having a body with a screw thread thereon that engages the screw thread on the body of each form block adjacent to the blind-ended bore of the friction unit and a friction head on the body of the friction element of the friction unit, (d) a counter-bore defined in the body of each form block adjacent to the blind-ended bore of the friction unit, and (e) the friction head of the friction element of the friction unit being movable in the blind-ended bore and in the counter-bore of the friction unit on each form block between a workpiece-surface engaging position and a stored position and frictionally engaging the workpiece-supporting surface when the friction element is in the workpiece-supporting surface engaging position and the form block on which the friction unit is mounted is located on said workpiece-supporting surface;

C) a plurality of aluminum clamp blocks, each clamp block including (1) a body which includes (a) a top, (b) a bottom, (c) a longitudinal axis extending between the top of each clamp block and the bottom of each clamp block, (d) a first side, (e) a second side, (f) a transverse axis extending between the first side and the second side of each clamp block, (g) an electromagnet accommodating section defined in the body of each clamp block adjacent to the bottom of each clamp block, (h) a front surface, (i) a rear surface, (j) a longitudinally extending blind-ended bore defined from the top of the body of each clamp block toward the bottom of the body of each clamp block along the longitudinal axis of the body of each clamp block and which is located between the front surface and the rear surface of the body of each clamp block and near the first side of the body of each clamp block, (k) two transversely extending blind-ended bores defined from the first side of the body of each clamp block toward the second side of the body of each clamp block along the transverse axis of the body of each clamp block and between the front surface and the back surface of the body of each clamp block and intersecting the longitudinally extending blind-ended bore defined in the body of each clamp block and being spaced apart from each other along the longitudinal axis of the body of each clamp block, (l) a width measured between the first side to the second side of the body of each clamp block, (m) a length measured between the top and the bottom of the body of each clamp block, and (n) a thickness measured between the front surface and the rear surface of the body of each clamp block, (2) a rack located in each of the two transversely extending blind-ended bores defined in the body of each clamp block, each rack extending out of the transversely extending blind-ended bore and having a distal end located outside of the transversely extending blind-ended bore and a proximal end located inside the transversely extending blind-ended bore, (3) a workpiece-engaging element mounted on the distal ends of the two racks of each clamp block and including (a) a body having (i) a top end located adjacent to the top of the body of the clamp block on which the workpiece-engaging element is mounted, (ii) a bottom end located adjacent to the bottom of the body of the clamp block on which the workpiece-engaging element is mounted, (iii) a front side located adjacent to the front surface of the body of the clamp block on which the workpiece-engaging element is mounted, (iv) a rear side located adjacent to the rear surface of the body of the clamp block on which the workpiece-engaging element is mounted, (v) a longitudinal axis extending from the top end of the body of the workpiece-engaging element to the bottom end of the workpiece-engaging element, (vi) a length which is essentially equal to the length of the body of the clamp block on which the workpiece-engaging element is mounted, (vi) a thickness that is essentially equal to the thickness of the body of the clamp block on which the workpiece-engaging element is mounted, (vii) a workpiece-engaging surface, (viii) a second surface located adjacent to the first side of the body of the clamp block on which the workpiece-engaging element is mounted, and (ix) two rack distal end receiving blind-ended bores defined in the body of each workpiece-engaging element from the second surface of the body of each workpiece-engaging element toward the workpiece engaging surface of the body of the workpiece-engaging element, the distal ends of each of the racks being accommodated in the one of the rack distal end receiving blind-ended bores to attach each workpiece-engaging element to the body of one clamp block of the plurality of clamp blocks, and (4) a pinion unit associated with each clamp block and having (a) an elongated pinion gear located in the longitudinally extending blind-ended bore defined in the body of each clamp block and intersecting both of the two transversely extending blind-ended bores defined in the body of each clamp block and engaging the rack in each of the two transversely extending blind-ended bores defined in the body of each clamp block, (b) a distal end on.the elongated pinion gear and positioned outside of the longitudinally extending blind-ended bore defined in the body of each clamp block, (c) a handle on the distal end of the elongated pinion gear, (d) the elongated pinion gear meshingly engaging the racks to move those racks into and out of the transversely extending blind-ended bores defined in the body of each clamp block as the handle is rotated to move the workpiece-engaging element toward and away from the body of the clamp block on which the workpiece-engaging element is located, and (e) a lock on the top of the body of each clamp block and engaging the elongated pinion gear to prevent retrograde rotation of the elongated pinion gear when the lock is engaged with the elongated pinion gear, the lock including (i) a gear having gear teeth fixedly mounted on the elongated pinion gear for rotation therewith, (ii) a dog element pivotally mounted on the body of the clamp block and having a distal end, (iii) the dog element being movable between a rotation permitting position with the distal end thereof spaced from the gear teeth of the gear of the lock and a rotation preventing position with the distal end thereof engaging the gear teeth of the gear of the lock, (iv) a biasing element mounted on the body of the clamp block and engaging the dog element and biasing the dog element into the rotation preventing position, and (v) a release element mounted on the body of the clamp block and engaging the dog element to move the dog element into the rotation permitting position when the release element is manually activated, (5) an electromagnet accommodated in the electromagnet accommodating section defined in the body of each clamp block adjacent to the bottom of each clamp block, (6) an electric control circuit electrically connecting the electromagnet in each clamp block to a power source, which includes (a) an on/off switch in the electronic control circuit of each electromagnet of each clamp block and mounted on the body of each clamp block, and (b) an on/off indicator in the electronic control circuit of each electromagnet of each clamp block and mounted on the body of each clamp block, and (7) fasteners fastening the electromagnet of each clamp block to the body of each clamp block;

D) a trammel which includes (1) a base having (a) a top section, (b) a bottom section, (c) a rotatable connection connecting the top section to the bottom section so the top section will rotate with respect to the bottom section, (d) a permanent magnet in the bottom section of the base of said trammel, (e) said trammel being mounted on said workpiece-supporting surface by the permanent magnet of said trammel, and (g) a pivot element on the top section of the base of said trammel, (2) a trammel arm having (a) a proximal end pivotally connected to the pivot element of the base of said trammel, (b) a distal end, (c) two side edges that extend from the distal end of said trammel arm to the proximal end of said trammel arm, (d) a width dimension extending between the two side edges of said trammel arm, (e) a multiplicity of markings on the trammel arm, (f) a stop element slidably mounted on said trammel arm to move toward and away from the distal end of said trammel arm and having (i) a rear edge that extends along the width dimension of said trammel arm and has a dimension that is greater than the width dimension of said trammel arm, (ii) ends on the rear edge of the stop element of said trammel that are spaced apart from the side edges of said trammel arm with the rear edge of the stop element of said trammel arm extending away from the side edges of said trammel arm when the stop element is mounted on said trammel arm, (iii) the stop element being frictionally held on the trammel arm of said trammel, (e) a sight gauge slidably mounted on said trammel arm to move toward and away from the distal end of said trammel arm and having a gauge mark thereon which is located to be aligned with one of the markings on the trammel arm when the sight gauge is mounted on said trammel arm, (f) a lock on the sight gauge of said trammel arm to lock the sight gauge in place on said trammel arm, (g) said sight gauge being frictionally held on the trammel arm of said trammel, (h) when said trammel arm is mounted on the base of said trammel and said base is mounted on said workpiece-supporting surface, said trammel arm being rotatable in a plane that is parallel to said workpiece-supporting surface and said trammel arm being pivotable in a plane that is upright with respect to said workpiece-supporting surface; and E) the rear edge of the stop element of said trammel arm being movable with said trammel arm and defining a continuous and uninterrupted path over said workpiece-supporting surface and over said workpiece-supporting surface when said trammel arm is rotated about the base of said trammel arm when said trammel arm is mounted on said workpiece-supporting surface, the stop element of said trammel arm defining a form block location at any location along the continuous and uninterrupted path; and F) a form block at each form block location.

2. The unit for bending wood defined in claim 1 further including a magnetically attractive workpiece-engaging support engaging the permanent magnets in the workpiece-engaging side of the form blocks.

3. The unit for bending wood defined in claim 2 wherein each clamp block is located adjacent to one of said form blocks.

4. The unit for bending wood defined in claim 3 further including additional clamp blocks that are located between adjacent clamp blocks and are spaced from adjacent form blocks.

5. The unit for bending wood defined in claim 2 further including a heat shield covering adjacent form and clamp blocks.

6. A unit for bending wood into arcuate shapes comprising:

A) a magnetically attractive workpiece-supporting surface;

B) a trammel that is magnetically fixed to said workpiece-supporting surface at a center of curvature of a desired arcuate shape for a wood workpiece when in use;

C) a curve identifying element on said trammel that is set to define a radius of curvature for the desired arcuate shape when said trammel is moved over said workpiece-supporting surface;

D) a continuous and uninterrupted curve defined by said curve identifying element as said trammel is moved over said workpiece-supporting surface;

E) a form block that is fixed to said workpiece-supporting surface adjacent to said curve at a selected position;

F) an electromagnet in said form block fixing said form block to said workpiece-supporting surface;

G) a clamp block that is fixed to said workpiece-supporting surface adjacent to said curve and adjacent to said form block; and H) an electromagnet in said clamp block fixing said clamp block to said workpiece-supporting surface.

7. A form block for use with a unit for bending wood into arcuate shapes comprising:

(1) an aluminum body having
- (a) a top,
- (b) a bottom,
- (c) a longitudinal axis extending between the top and the bottom of the body of each form block,
- (d) a workpiece-engaging side extending between the top and the bottom of the body of each form block,
- (e) a second side spaced from the workpiece-engaging side of each form block,
- (f) a transverse axis extending between the workpiece-engaging side and the second side of each form block,
- (g) a handle section,
- (h) a channel defined in the workpiece-engaging side of each form block, and
- (i) an electromagnet accommodating section defined in the body of each form block adjacent to the bottom of each form block, (2) a magnet-supporting base slidably received in the channel on the workpiece-engaging side of each form block, (3) a plurality of permanent magnets magnetically fixed to the magnet-supporting base in each form block, the permanent magnets being spaced apart from each other along the longitudinal axis of each form block, (4) an electromagnet unit accommodated in the electromagnet accommodating section on each form block, (5) an electric control circuit electrically connecting the electromagnet in each form block to a power source, which includes
- (a) an on/off switch in the electronic control circuit of each electromagnet of each form block and mounted on the body of each electromagnet of each form block, and
- (b) an on/off indicator in the electronic control circuit of each electromagnet of each form block and mounted on the body of each electromagnet of each form block, (6) fasteners fastening the electromagnet unit of each form block to the body of each form block, and (7) a friction unit movably mounted on the bottom of the body of each form block and which includes
- (a) blind-ended bore defined in the body of each form block and extending from the bottom of the body of each form block along the longitudinal axis of the body of each form block toward the top of the body of each form block,
- (b) a screw thread defined in the body of each form block adjacent to the blind-ended bore of the friction unit,
- (c) a friction element having a body with a screw thread thereon that engages the screw thread on the body of each form block adjacent to the blind-ended bore of the friction unit and a friction head on the body of the friction element of the friction unit,
- (d) a counter-bore defined in the body of each form block adjacent to the blind-ended bore of the friction unit, and
- (e) the friction head of the friction element of the friction unit being movable in the blind-ended bore and in the counter-bore of the friction unit on each form block between a workpiece-surface engaging position and a stored position and frictionally engaging the workpiece-supporting surface when the friction element is in the workpiece-supporting surface engaging position and the form block on which the friction unit is mounted is located on said workpiece-supporting surface.

8. A clamp block for use with a unit for bending wood into arcuate shapes comprising:

(1) a body which includes
- (a) a top,
- (b) a bottom,
- (c) a longitudinal axis extending between the top of each clamp block and the bottom of each clamp block,
- (d) a first side,
- (e) a second side,
- (f) a transverse axis extending between the first side and the second side of each clamp block,
- (g) an electromagnet accommodating section defined in the body of each clamp block adjacent to the bottom of each clamp block,
- (h) a front surface,
- (i) a rear surface,
- (j) a longitudinally extending blind-ended bore defined from the top of the body of each clamp block toward the bottom of the body of each clamp block along the longitudinal axis of the body of each clamp block and which is located between the front surface and the rear surface of the body of each clamp block and near the first side of the body of each clamp block,
- (k) two transversely extending blind-ended bores defined from the first side of the body of each clamp block toward the second side of the body of each clamp block along the transverse axis of the body of each clamp block and between the front surface and the back surface of the body of each clamp block and intersecting the longitudinally extending blind-ended bore defined in the body of each clamp block and being spaced apart from each other along the longitudinal axis of the body of each clamp block,
- (l) a width measured between the first side and the second side of the body of each clamp block,
- (m) a length measured between the top and the bottom of the body of each clamp block, and
- (n) a thickness measured between the front surface and the rear surface of the body of each clamp block, (2) a rack located in each of the two transversely extending blind-ended bores defined in the body of each clamp block, each rack extending out of the transversely extending blind-ended bore and having a distal end located outside of the transversely extending blind-ended bore and a proximal end located inside the transversely extending blind-ended bore, (3) a workpiece-engaging element mounted on the distal ends of the two racks of each clamp block and including
- (a) a body having
  - (i) a top end located adjacent to the top of the body of the clamp block on which the workpiece-engaging element is mounted,
  - (ii) a bottom end located adjacent to the bottom of the body of the clamp block on which the workpiece-engaging element is mounted,
  - (iii) a front side located adjacent to the front surface of the body of the clamp block on which the workpiece-engaging element is mounted, (iv) a rear side located adjacent to the rear surface of the body of the clamp block on which the workpiece-engaging element is mounted, (v) a longitudinal axis extending from the top end of the body of the workpiece-engaging element to the bottom end of the workpiece-engaging element, (vi) a length which is essentially equal to the length of the body of the clamp block on which the workpiece-engaging element is mounted, (vi) a thickness that is essentially equal to the thickness of the body of the clamp block on which the workpiece-engaging element is mounted, (vii) a workpiece-engaging surface, (viii) a second surface located adjacent to the first side of the body of the clamp block on which the workpiece-engaging element is mounted, and (ix) two rack distal end receiving blind-ended bores defined in the body of each workpiece-engaging element from the second surface of the body of each workpiece-engaging element toward the workpiece engaging surface of the body of the workpiece-engaging element, the distal ends of each of the racks being accommodated in the one of the rack distal end receiving blind-ended bores to attach each workpiece-engaging element to the body of one clamp block of the plurality of clamp blocks, and (4) a pinion unit associated with each clamp block and having (a) an elongated pinion gear located in the longitudinally extending blind-ended bore defined in the body of each clamp block and intersecting both of the two transversely extending blind-ended bores defined in the body of each clamp block and engaging the rack in each of the two transversely extending blind-ended bores defined in the body of each clamp block, (b) a distal end on the elongated pinion gear and positioned outside of the longitudinally extending blind-ended bore defined in the body of each clamp block, (c) a handle on the distal end of the elongated pinion gear, (d) the elongated pinion gear meshingly engaging the racks to move those racks into and out of the transversely extending blind-ended bores defined in the body of each clamp block as the handle is rotated to move the workpiece-engaging element toward and away from the body of the clamp block on which the workpiece-engaging element is located, and (e) a lock on the top of the body of each clamp block and engaging the elongated pinion gear to prevent retrograde rotation of the elongated pinion gear when the lock is engaged with the elongated pinion gear, the lock including (i) a gear having gear teeth fixedly mounted on the elongated pinion gear for rotation therewith, (ii) a dog element pivotally mounted on the body of the clamp block and having a distal end, (iii) the dog element being movable between a rotation permitting position with the distal end thereof spaced from the gear teeth of the gear of the lock and a rotation preventing position with the distal end thereof engaging the gear teeth of the gear of the lock, (iv) a biasing element mounted on the body of the clamp block and engaging the dog element and biasing the dog element into the rotation preventing position, and (v) a release element mounted on the body of the clamp element and engaging the dog element to move the dog element into the rotation permitting position when the release element is manually activated, (5) an electromagnet accommodated in the electromagnet accommodating section defined in the body of each clamp block adjacent to the bottom of each clamp block, (6) an electric control circuit electrically connecting the electromagnet in each form block to a power source, which includes (a) an on/off switch in the electronic control circuit of each electromagnet of each clamp block and mounted on the body of each electromagnet of each clamp block, and (b) an on/off indicator in the electronic control circuit of each electromagnet of each clamp block and mounted on the body of each electromagnet of each clamp block, and (7) fasteners fastening the electromagnet unit of each clamp block to the body of each clamp block.

9. A trammel element for use with a unit for bending wood into arcuate shapes comprising:

(1) a base having (a) a top section, (b) a bottom section, (c) a rotatable connection connecting the top section to the bottom section so the top section will rotate with respect to the bottom section, (d) a permanent magnet in the bottom section of the base of said trammel, (e) when in use, said trammel being mounted on said workpiece-supporting surface by the permanent magnet of said trammel, and (g) a pivot element on the top section of the base of said trammel, (2) a trammel arm having (a) a proximal end pivotally connected to the pivot element of the base of said trammel, (b) a distal end, (c) two side edges that extend from the distal end of said trammel arm to the proximal end of said trammel arm, (d) a width dimension extending between the two side edges of said trammel arm, (e) a multiplicity of markings on the trammel arm, (f) a stop element slidably mounted on said trammel arm to move toward and away from the distal end of said trammel arm and having (i) a rear edge that extends along the width dimension of said trammel arm and has a dimension that is greater than the width dimension of said trammel arm, (ii) ends on the rear edge of the stop element of said trammel that are spaced apart from the sides of said trammel arm with the rear edge of the stop element of said trammel arm extending away from the side edges of said trammel arm when the stop element is mounted on said trammel arm, (iii) the stop element frictionally engaging the trammel arm of said trammel, (e) a sight gauge slidably mounted on said trammel arm to move toward and away from the distal end of said trammel arm and having a gauge mark thereon which is located to be aligned with one of the markings on the trammel arm when the sight gauge is mounted on said trammel arm, (f) a lock on the sight gauge of said trammel arm to lock the sight gauge in place on said trammel arm, (g) the sight gauge frictionally engaging the trammel arm of said trammel, (h) when said trammel arm is mounted on the base of said trammel and said base is mounted on said workpiece-supporting surface, said trammel arm is rotatable in a plane that is parallel to said workpiece-supporting surface and said trammel is pivotable in a plane that is upright with respect to said workpiece-supporting surface; and E) the rear edge of the stop element of said trammel arm being movable with said trammel arm and defining a continuous and uninterrupted path over said workpiece-supporting surface when said trammel arm is rotated about the base of said trammel arm and over said workpiece-supporting surface when said trammel arm is mounted on said workpiece-supporting surface, the stop element of said trammel arm defining a form block location at any location along the continuous and uninterrupted path.

10. A method for bending wood into arcuate shapes comprising:

A) providing a planar magnetically attractive workpiece supporting surface;

B) locating a center of curvature for a first arcuate section of a wood arcuate shape;

C) placing a first permanent magnet at the center of curvature for the first arcuate section;

D) pivotally and rotatably attaching a trammel to the first permanent magnet;

E) selecting a continuous and uninterrupted first radius of curvature for the first arcuate section;

F) identifying the first radius of curvature on the trammel;

G) rotating the trammel in a plane that is parallel to a plane containing the planar workpiece-supporting surface;

H) defining a continuous and uninterrupted arcuate curve over the workpiece-supporting surface using the trammel;

I) identifying a first location on the workpiece-supporting surface on the arcuate curve using the trammel;

J) placing a first form block at the first location on the workpiece-supporting surface;

K) electromagnetically fixing the first form block to the workpiece-supporting surface at the first location on the workpiece-supporting surface;

L) orienting a workpiece-engaging side of the first form block to be upright with respect to the workpiece-supporting surface;

M) attaching a permanent magnet to the workpiece-engaging side of the first form block;

N) rotating the trammel in the plane parallel to the plane containing the workpiece-supporting surface along the continuous and uninterrupted path over the workpiece-supporting surface to a second location on the workpiece-supporting surface;

O) placing a second form block at the second location on the workpiece-supporting surface;

P) electromagnetically fixing the second form block to the workpiece-supporting surface at the second location on the workpiece-supporting surface;

Q) orienting a workpiece-engaging side of the second form block to be upright with respect to the workpiece-supporting surface;

R) attaching a permanent magnet to the workpiece-engaging side of the second form block;

S) repeating the trammel rotating, the form block placing, the form block fixing, the workpiece-engaging side orienting and the electromagnetically fixing steps until a plurality of form blocks have been placed on the workpiece-supporting surface at any and all desired locations on the continuous and uninterrupted arcuate curve over the workpiece-supporting surface;

T) placing a magnetically attractive workpiece-engaging support against the permanent magnets in the workpiece-engaging surface of the electromagnetically fixed form blocks;

U) placing a wood workpiece against the magnetically attractive workpiece-engaging support;

V) placing a first clamp block on the workpiece-supporting surface adjacent to the continuous and uninterrupted arcuate curve over the workpiece-supporting surface and adjacent to the workpiece-engaging surface of the first form block;

W) electromagnetically fixing the first clamp block to the workpiece-engaging surface;

X) orienting a workpiece-engaging element of the first clamp block to be parallel to the workpiece-engaging surface of the first form block;

Y) placing a second clamp block on the workpiece-supporting surface adjacent to the continuous and uninterrupted arcuate curve over the workpiece-supporting surface and adjacent to the workpiece-engaging surface of the second form block;

Z) electromagnetically fixing the second clamp block to the workpiece-engaging surface;

AA) orienting a workpiece-engaging element of the second clamp block to be parallel to the workpiece-engaging surface of the second form block;

BB) repeating the clamp block placing, the clamp block electromagnetic fixing and the workpiece-engaging element orienting steps for each form block;

CC) moving a workpiece-engaging element of one clamp block of the plurality of clamp blocks into contact with the wood workpiece;

DD) securely clamping the wood workpiece between the moved workpiece-engaging element of the one clamp block and the workpiece-engaging surface of the form block adjacent to the one clamp block;

EE) locking the workpiece-engaging element of the one clamp block in a workpiece clamping position; and FF) repeating the workpiece-engaging element moving and the secure clamping of the wood workpiece and the locking of the workpiece-engaging element until the workpiece has been securely clamped between all the form blocks and clamp blocks located on the first arcuate section.

11. The method defined in claim 10 further including locating a center of curvature for a second arcuate section and repeating the steps defined in claim 1 for the second arcuate section.

12. The method defined in claim 10 further including placing a clamp block between adjacent form blocks, electromagnetically fixing the further clamp block to the workpiece-supporting surface, orienting a workpiece-engaging element of the further clamp block to be upright with respect to the workpiece-supporting surface, and moving the workpiece-engaging element of the further clamp block into contact with the wood workpiece.

13. The method defined in claim 10 further including laminating the wood workpiece.

14. The method defined in claim 10 further including frictionally engaging one of the form blocks with the workpiece-supporting surface.

15. The method defined in claim 13 further including thermally connecting the electromagnetically fixed form blocks to the electromagnetically fixed clamp blocks and to the wood workpiece.

16. The method defined in claim 10 further including locating a center of curvature for each of a plurality of arcuate sections and repeating the steps of claim 1 for each arcuate section of the plurality of arcuate sections.

17. The method defined in claim 10 wherein the steps of electromagnetically fixing the form blocks to the workpiece-supporting surface occur individually.

18. The method defined in claim 17 wherein the steps of electromagnetically fixing the clamp blocks to the workpiece-supporting surface occur individually.

19. A method for bending wood into an arcuate shape comprising:

A) providing a magnetically attractive workpiece-supporting surface;

B) defining a continuous and uninterrupted first arcuate portion for a wood workpiece;

C) locating a plurality of form blocks at any and all desired locations adjacent to the continuous and uninterrupted first arcuate portion for the wood workpiece;

D) locating a clamp block adjacent to each form block of the plurality of form blocks;

E) electromagnetically fixing all of the form blocks and all of the clamp blocks to the workpiece-supporting surface;

F) placing a wood workpiece between at least one form block and adjacent to a clamp block;

G) securely clamping the wood workpiece between the one form block and the adjacent clamp block;

H) repeating the steps of securely clamping the wood workpiece between form blocks and clamp blocks until the wood workpiece has been securely clamped between all form blocks and the clamp blocks adjacent thereto.

20. The method defined in claim 19 further including defining a plurality of arcuate portions for the wood workpiece and repeating the steps of claim 19 for each arcuate portion of the plurality of arcuate portions.

21. The method defined in claim 19 further including placing a clamp block between adjacent form blocks, electromagnetically fixing the further clamp block to the workpiece-supporting surface, orienting a workpiece-engaging element of the further clamp block to be upright with respect to the workpiece-supporting surface, and moving the workpiece-engaging element of the further clamp block into contact with the wood workpiece.

22. The method defined in claim 19 further including frictionally engaging one of the form blocks with the workpiece-supporting surface.

23. The method defined in claim 19 wherein the steps of electromagnetically fixing the form blocks to the workpiece-supporting surface occur individually.

24. The method defined in claim 23 wherein the steps of electromagnetically fixing the clamp blocks to the workpiece-supporting surface occur individually.

* * * * *